US008933357B2

(12) United States Patent
Kim et al.

(10) Patent No.: US 8,933,357 B2
(45) Date of Patent: Jan. 13, 2015

(54) VACUUM INTERRUPTER

(75) Inventors: Byung Chul Kim, Cheongju-Si (KR); Sung Tae Kim, Cheongju-Si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 204 days.

(21) Appl. No.: 13/615,611

(22) Filed: Sep. 14, 2012

(65) Prior Publication Data

US 2013/0062315 A1 Mar. 14, 2013

(30) Foreign Application Priority Data

Sep. 14, 2011 (KR) ..... 20-2011-0008299

(51) Int. Cl.

| | |
|---|---|
| ***H01H 33/66*** | (2006.01) |
| ***H01H 9/30*** | (2006.01) |
| ***H01H 1/66*** | (2006.01) |
| ***H01H 33/662*** | (2006.01) |

(52) U.S. Cl.

CPC ..... *H01H 33/66261* (2013.01); *H01H 2033/66276* (2013.01); *H01H 2033/66292* (2013.01)

USPC ..... 218/121; 218/118; 218/134; 218/136; 218/137; 218/147; 335/151

(58) Field of Classification Search

USPC ..... 218/134–137, 118, 121, 147, 151; 335/151

See application file for complete search history.

(56) References Cited

U.S. PATENT DOCUMENTS

| | | | | |
|---|---|---|---|---|
| 3,026,394 | A * | 3/1962 | Emmett | 218/118 |
| 8,039,771 | B2 * | 10/2011 | Trondsen | 218/136 |

FOREIGN PATENT DOCUMENTS

| | | |
|---|---|---|
| JP | 49-6473 | 1/1974 |
| JP | 58-195934 | 12/1983 |
| JP | 5-028888 | 2/1993 |
| JP | 7-302529 | 11/1995 |
| JP | 9-293434 | 11/1997 |
| JP | 2004-362918 | 12/2004 |

OTHER PUBLICATIONS

English Machine Translation of JP19935028888.*
English Machine Translation of JP 19957302529.*
Japan Patent Office Application Serial No. 2012-201204, Notice of Allowance dated Jan. 28, 2014, 3 pages.
European Patent Office Application Serial No. 12182183.9, Search Report dated Jan. 30, 2013, 8 pages.

* cited by examiner

*Primary Examiner* — Renee Luebke
*Assistant Examiner* — William Bolton
(74) *Attorney, Agent, or Firm* — Lee, Hong, Degerman, Kang & Waimey

(57) ABSTRACT

The present disclosure relates to a vacuum interrupter capable of easily installing a central arc shielding plate in alignment without biasing in a radial direction. The vacuum interrupter includes a protruding guide unit protruding from a stationary electrode seal cup in a perpendicular direction to guide the installation of the central arc shielding plate such that the central arc shielding plate can be aligned in a radial direction.

6 Claims, 5 Drawing Sheets

VACUUM INTERRUPTER

CROSS-REFERENCE TO RELATED APPLICATIONS

Pursuant to 35 U.S.C. §119(a), this Application claims the benefit of earlier filing date and right of priority to Korean Patent Application No. 20-2011-0008299, filed on Sep. 14, 2011, the contents of which are all hereby incorporated by reference herein in its entirety.

BACKGROUND OF THE INVENTION

1. Field of the Invention

This disclosure relates to a vacuum interrupter, and particularly, to a vacuum interrupter having a protruding guide unit at a stationary electrode seal cup, capable of guiding alignment of a central arc shielding plate such that the central arc shielding plate can be installed without being biased to one side in a radial direction.

2. Background of the Invention

A vacuum interrupter is an electrical power device in which contacts are contained in a container present in a vacuum state so as to fast extinguish arc, which is generated upon switching on or off an electrical power circuit of high or ultra high voltage. The vacuum interrupter is used in a power station, a substation, an electric power distribution board of a large electrical power consumer or the like by being installed as a core component of a vacuum circuit breaker together with a switching mechanism for switching a movable contact to a closing or opening position, an actuator, a trip controller and the like.

Hereinafter, description will be given of configuration and operation of the vacuum interrupter according to the related art with reference to FIG. 1.

As shown in FIG. 1, a vacuum interrupter includes a stationary electrode 1, a stationary contact 2, a movable contact 4, a movable electrode 3, a ceramic container 8, a stationary electrode cover plate 9, a stationary electrode seal cup 10, a movable electrode cover plate 13, a movable electrode seal cup 7, a bellows 5 and a central arc shielding plate 11.

The related art vacuum interrupter of FIG. 1 may further include a first shielding plate 6 for protection of the bellows 5, a second shielding plate 7*a* for protection of the bellows 5, and a splash shielding plate 12.

The stationary electrode 1 is a position-fixed electrode and configured as an electrically conductive rod. The stationary electrode 1 may be electrically connected to an electrical power source side of the electrical power circuit (abbreviated as circuit hereinafter).

The stationary contact 2 may be coupled to an end of the stationary electrode 1 by a welding, and can be configured as an electrically conductive disk.

The movable contact 4 is movable to a position of contacting the stationary contact 2 or a position of being separated from the stationary contact 2, and configured as an electrically conductive disk.

The movable electrode 3 supports the movable contact 4 by being welded onto the movable contact 4, and is movable together with the movable contact 4. The movable electrode 3 is formed of an electrically conductive material, and may be electrically connected to an electrical load side of the circuit.

The ceramic container 8 is an enclosure for receiving the stationary contact and the movable contact 4 therein, and has a tubular shape having upper and lower portions open.

The stationary electrode cover plate 9 is an annular member which is installed at a side of the stationary electrode 1 and has a central through hole for allowing the stationary electrode 1 to be inserted therethrough. The stationary electrode cover plate 9 seals the upper or lower open portion of the ceramic container 8.

The stationary electrode seal cup 10 is connected to seal a gap between the ceramic container 8 and the stationary electrode cover plate 9. The stationary electrode seal cup 10 may be made of a metal which has one side section in a shape similar to alphabet "L" and has an annular shape as a whole. The stationary electrode seal cup 10 may be connected to the ceramic container 8 and the stationary electrode cover plate 9, respectively, in a welding manner.

The movable electrode cover plate 13 is installed at a side of the movable electrode 3, and is an annular member which has a central through hole whose diameter is greater than an outer diameter of the movable electrode 3 for allowing an axial movement of the movable electrode 3. The movable electrode cover plate 13 seals an upper or lower open portion of the ceramic container 8.

The movable electrode seal cup 7 is a member connected to seal a gap between the ceramic container 8 and the movable electrode cover plate 13. The movable electrode seal cup 7 may be made of a metal which has one side section in a shape similar to alphabet "L" and has an annular shape as a whole. The movable electrode seal cup 7 may be connected to the ceramic container 8 and the movable electrode cover plate 13, respectively, in a welding manner.

The bellows 5 is a member whose both ends are connected to the movable electrode cover plate 13 and the movable electrode 3, respectively, for sealing a gap between the movable electrode cover plate 13 and the movable electrode 3. The bellows 5 has a plurality of metallic wrinkles so as to be expandable and contractible in response to the axial movement of the movable electrode 3.

The central arc shielding plate 11 is a shielding plate fixed between the ceramic container 8 and the contacts, namely, the stationary contact 2 and the movable contact 4 so as to shield arc, which is generated between the stationary contact 2 and the movable contact 4 upon switching on or off the contacts, from being delivered directly toward an inner wall of the ceramic container 8.

The first shielding plate 6 for protection of the bellows 5 is a shielding plate, which has a "U"-like longitudinal section and is in a tubular shape with upper and lower sides open. One open end of the first shielding plate 6 is connected to the movable electrode 3 in the welding manner so as to shield a portion of the bellows 5, which is adjacent to the movable contact 4, protecting the corresponding portion from arc at the outside of the bellows 5.

The second shielding plate 7*a* for protection of the bellows 5 is a metal member which has a side section in a hook-like shape and has an annular shape as a whole. The second shielding plate 7*a* may have one end portion welded onto the movable electrode seal cup 7 and another end portion extending from the one end portion toward the movable contact 4 at the outside of the bellows 5.

The splash shielding plate 12 is a disk-like metal plate having a central through hole for allowing an end portion of the movable electrode 3 to be inserted therethrough. The splash shielding plate 12 may be welded onto the end portion of the movable electrode 3 and shield a rear side of the movable electrode 3 and a portion near one side of the bellows 5 so as to protect them from metallic vapor generated due to arc.

Hereinafter, detailed description will be given of configuration and method for installing the central arc shielding plate according to the related art with reference to FIGS. 2 and 3.

The central arc shielding plate 11 according to one embodiment of the related art, as shown in FIG. 2, is closely adhered onto the stationary electrode seal cup 10 on the stationary electrode cover plate 9 and welded thereonto for installation.

However, in the installation method for the central arc shielding plate 11 according to the one embodiment of the related art, there is not any member provided for guiding the central arc shielding plate 11 to be installed without being biased to one side on the stationary electrode cover plate 9 in a radial direction. This may make it difficult to align the central arc shielding plate 11 upon installation thereof.

Also, the related art central arc shielding plate 11 according to another embodiment, as shown in FIG. 3, is closely adhered onto an alignment plate 14 after the alignment plate 14 is installed on the stationary electrode cover plate 9, and then welded thereonto for installation.

In the installation method for the central arc shielding plate 11 according to the another embodiment of the related art, the additional component, namely, the alignment plate 14, is required. This causes several problems, such as an increase in fabrication costs for the vacuum interrupter due to the increase in the number of components, lowering of productivity due to an additional fabrication process, an increase in portions to be welded, and an increase in defectively welded portions.

SUMMARY OF THE INVENTION

Therefore, to overcome the shortcomings of the related art, an aspect of the present disclosure is to provide a vacuum interrupter having a protruding guide unit at a stationary electrode seal cup, capable of guiding alignment of a central arc shielding plate such that the central arc shielding plate can be installed without being biased to one side in a radial direction.

To achieve these and other advantages and in accordance with the purpose of this disclosure, as embodied and broadly described herein, there is provided a vacuum interrupter comprising:

a stationary electrode;

a stationary contact coupled to the stationary electrode;

a movable contact movable to a position of contacting the stationary contact or a position of being separated from the stationary contact;

a movable electrode coupled to the movable contact to support the movable contact, the movable electrode movable together with the movable contact;

a ceramic container receiving the stationary contact and the movable contact therein, the ceramic container having upper and lower portions open;

a stationary electrode cover plate installed at a side of the stationary electrode and having a central through hole for allowing the stationary electrode to be inserted therethrough;

a stationary electrode seal cup connected to seal a gap between the ceramic container and the stationary electrode cover plate;

a movable electrode cover plate installed at a side of the movable electrode, and having a central through hole having a diameter greater than an outer diameter of the movable electrode to allow the movable electrode to be movable in an axial direction;

a movable electrode seal cup connected to seal a gap between the ceramic container and the movable electrode cover plate;

a bellows having both ends connected to the movable electrode cover plate and the movable electrode, respectively, to seal a gap between the movable electrode cover plate and the movable electrode, the bellows being expandable or contractible in response to the axial movement of the movable electrode;

a central arc shielding plate fixed between the ceramic container and the stationary and movable contacts; and a protruding guide unit protruding from the stationary electrode seal cup in a perpendicular direction to guide the central arc shielding plate to be installed in alignment in a radial direction.

In one aspect of the present disclosure, the protruding guide unit may include one circular protrusion guide portion.

In another aspect of the present disclosure, the protruding guide unit may include a plurality of arcuate protrusion guide portions formed along one circumference.

In another aspect of the present disclosure, the protruding guide unit may include a plurality of protrusion guide portions formed along one circumference.

In another aspect of the present disclosure, the one circular protrusion guide portion or the one circumference on which the plurality of arcuate protrusion guide portions are formed may have a diameter predetermined to correspond to an inner diameter of the central arc shielding plate, such that the one circular protrusion guide portion or the plurality of arcuate protrusion guide portions can be press-fitted into the central arc shielding plate.

In another aspect of the present disclosure, the protruding guide unit may be embossed by pressing.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this disclosure, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, description will be given of a configuration and an operational effect of a vacuum interrupter according to this disclosure with reference to FIGS. 4 to 8.

Figure 1:
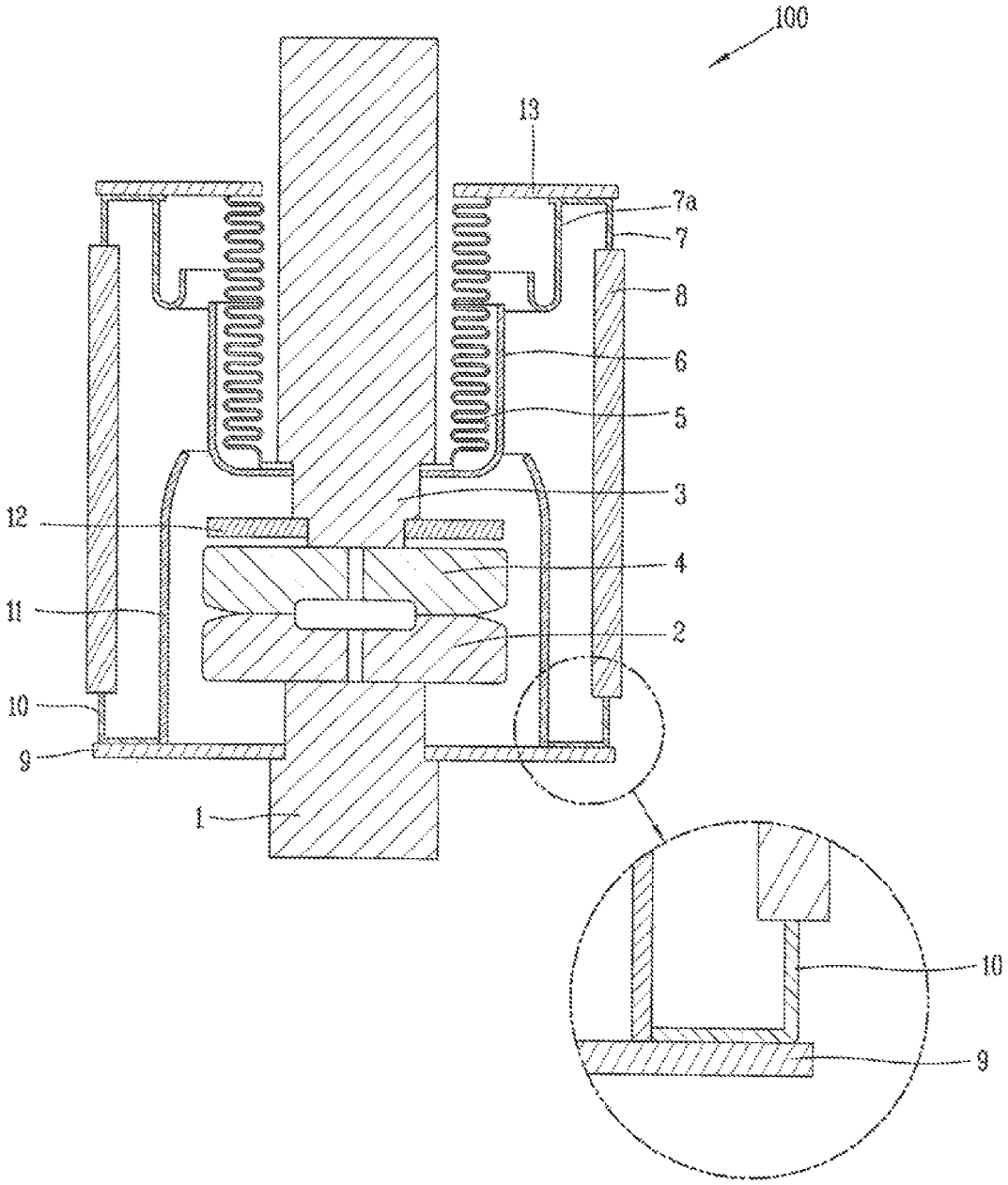
FIG. 1 RELATED ART
FIG. 1 is a longitudinal sectional view showing an overall configuration of a vacuum interrupter according to the related art.
Figure 2:
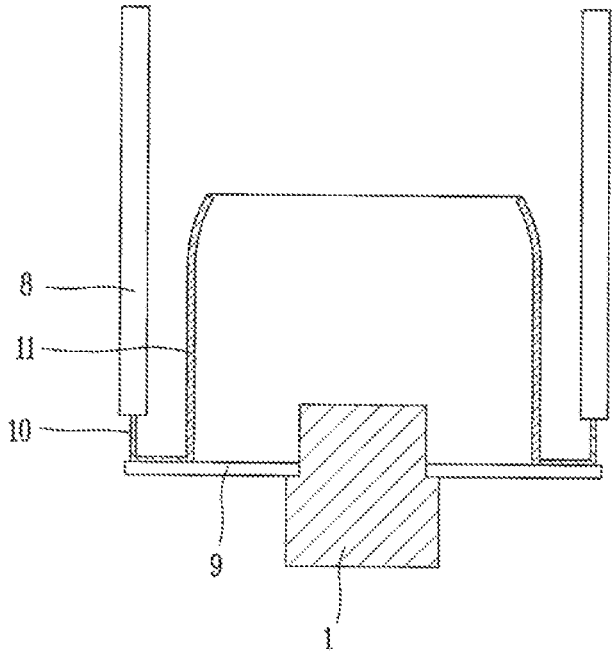
FIG. 2 RELATED ART
FIG. 2 is a longitudinal sectional view of a part of the vacuum interrupter showing a configuration for installing a central arc shielding plate according to one embodiment of the related art.
Figure 3:
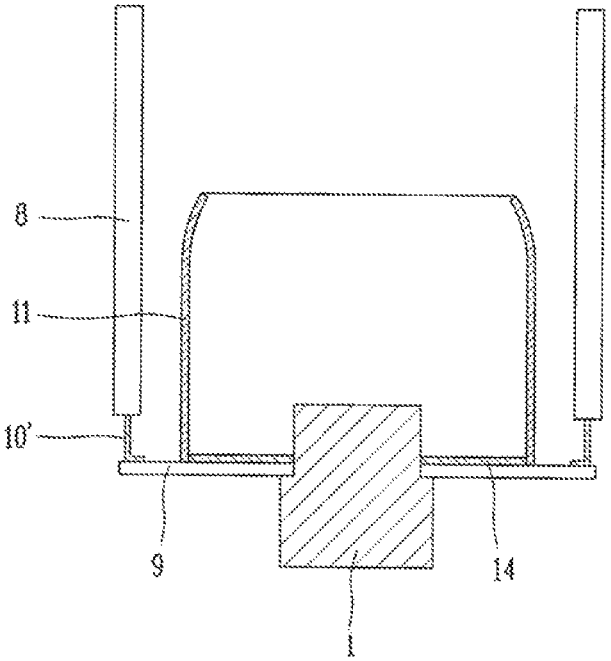
FIG. 3 RELATED ART
FIG. 3 is a longitudinal sectional view of a part of the vacuum interrupter showing a configuration for installing a central arc shielding plate according to another embodiment of the related art.
Figure 4:
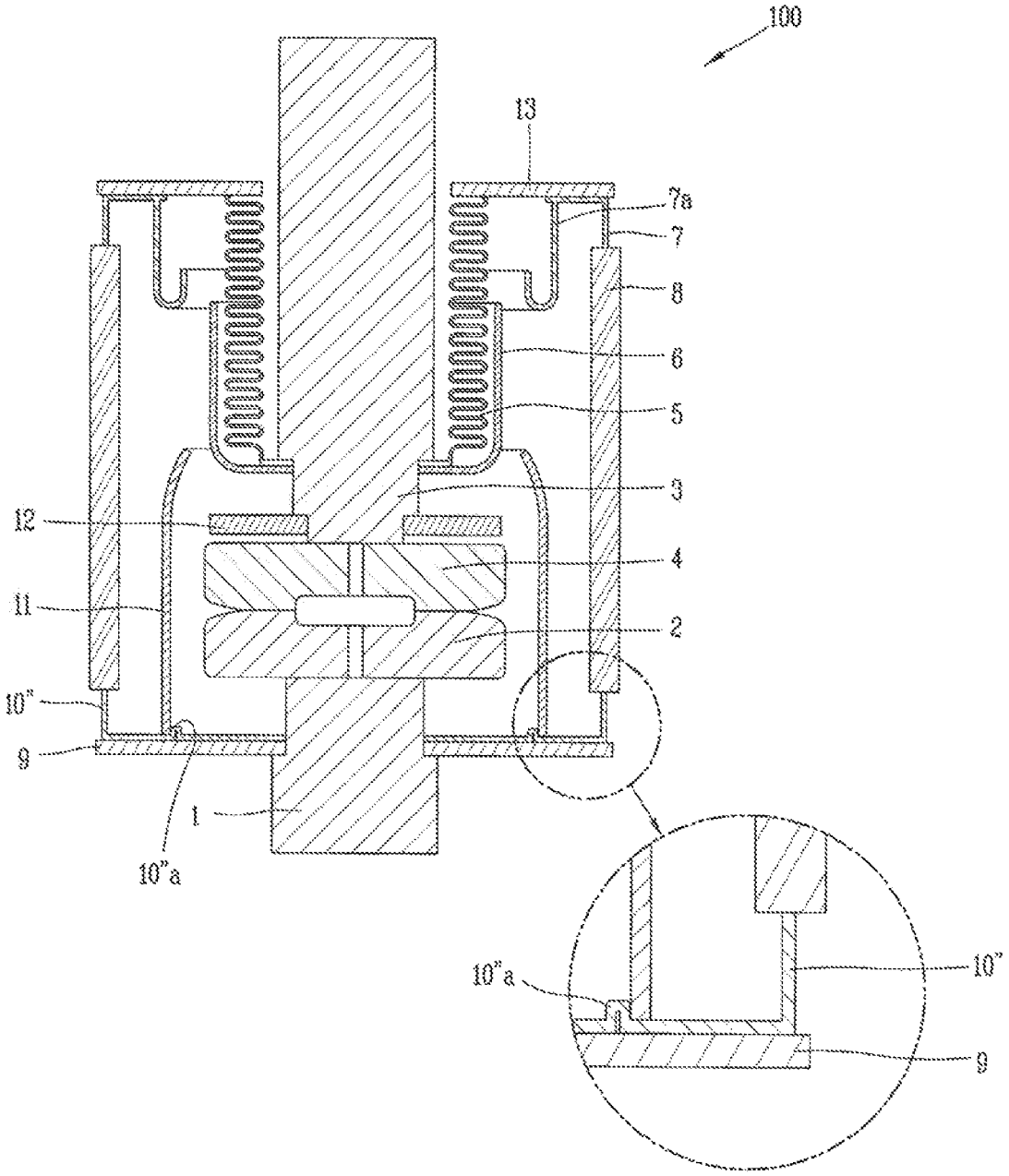
FIG. 4 is a longitudinal sectional view showing an overall configuration of a vacuum interrupter according to this disclosure.

As shown in FIG. 4, a vacuum interrupter 100 according to this disclosure may include a stationary electrode 1, a stationary contact 2, a movable contact 4, a movable electrode 3, a ceramic container 8, a stationary electrode cover plate 9, a stationary electrode seal cup 10", a movable electrode cover plate 13, a movable electrode seal cup 7, a bellows 5, a central arc shielding plate 11, and a protruding guide unit 10"*a*.

The vacuum interrupter 100 may further include a first shielding plate 6 for protection of the bellows 5, a second shielding plate 7*a* for protection of the bellows 5, and a splash shielding plate 12.

The stationary electrode 1 is a position-fixed electrode and configured as an electrically conductive rod. The stationary electrode 1 may be electrically connected to an electrical power source side of the circuit.

The stationary contact 2 may be coupled to an end of the stationary electrode 1 in a welding manner, and configured as an electrically conductive disk.

The movable contact 4 is movable to a position of contacting the stationary contact 2 and a position of being separated from the stationary contact 2, and configured as an electrically conductive disk.

The movable electrode 3 supports the movable contact 4 by being welded onto the movable contact 4, and is movable together with the movable contact 4. The movable electrode 3 is formed of an electrically conductive material, and may be electrically connected to an electrical load side of the circuit.

The ceramic container 8 is an enclosure for receiving the stationary contact 2 and the movable contact 4 therein, and has a tubular shape having upper and lower portions open.

The stationary electrode cover plate 9 is an annular member which is installed at a side of the stationary electrode 1 and has a central through hole for allowing the stationary electrode 1 to be inserted therethrough. The stationary electrode cover plate 9 seals the upper or lower open portion of the ceramic container 8.

The stationary electrode seal cup 10" is connected to seal a gap between the ceramic container 8 and the stationary electrode cover plate 9. The stationary electrode seal cup 10" may be made of a metal which has one side section in a shape similar to alphabet "L" and has an annular shape as a whole. The stationary electrode seal cup 10" may be connected to the ceramic container 8 and the stationary electrode cover plate 9, respectively, in a welding manner.

Figure 5:
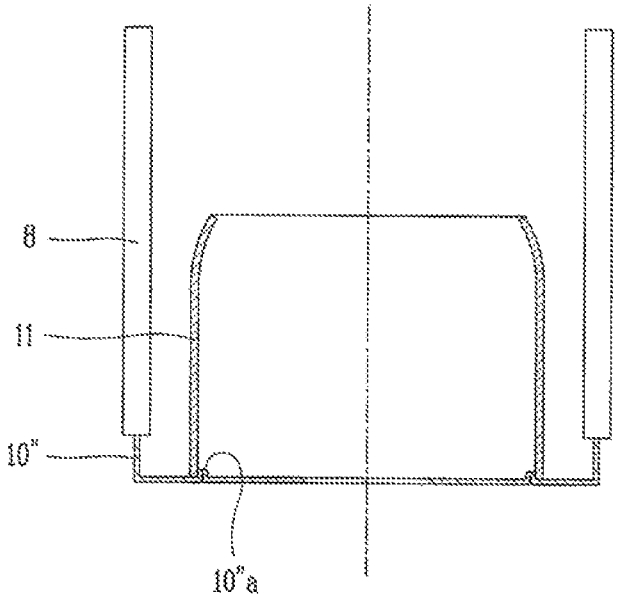
FIG. 5 is a longitudinal sectional view of a part of the vacuum interrupter showing a configuration for installing a central arc shielding plate according to a preferred exemplary embodiment of this disclosure.

As shown in FIGS. 4 and 5, a protruding guide unit 10"*a* may protrude from the stationary electrode seal cup 10" in a perpendicular direction, so as to guide the central arc shielding plate 11 to be installed in a radial direction in alignment.

The movable electrode cover plate 13 is installed at a side of the movable electrode 3, and is an annular member which has a central through hole whose diameter is greater than an outer diameter of the movable electrode 3 for allowing an axial movement of the movable electrode 3. The movable electrode cover plate 13 seals the upper or lower open portion of the ceramic container 8.

The movable electrode seal cup 7 is a member connected to seal a gap between the ceramic container 8 and the movable electrode cover plate 13. The movable electrode seal cup 7 may be made of a metal which has one side section in a shape similar to alphabet "L" and has an annular shape as a whole. The movable electrode seal cup 7 may be connected to the ceramic container 8 and the movable electrode cover plate 13, respectively, in a welding manner.

The bellows 5 is a member whose both ends are connected to the movable electrode cover plate 13 and the movable electrode 3, respectively, for sealing a gap between the movable electrode cover plate 13 and the movable electrode 3. The bellows 5 has a plurality of metallic wrinkles so as to be expandable and contractible in response to the axial movement of the movable electrode 3.

The central arc shielding plate 11 is a shielding plate fixed between the ceramic container 8 and the contacts, namely, the stationary contact 2 and the movable contact 4 so as to shield arc, which is generated between the stationary contact 2 and the movable contact 4 upon switching on or off the contacts, from being delivered directly toward an inner wall of the ceramic container 8.

The first shielding plate 6 for protection of the bellows 5 is a shielding plate, which has a "U"-like longitudinal section and is in a tubular shape with upper and lower sides open. One open end of the first shielding plate 6 is connected to the movable electrode 3 in the welding manner so as to shield a portion of the bellows 5, which is adjacent to the movable contact 4, protecting the corresponding portion from arc at the outside of the bellows 5.

The second shielding plate 7*a* for protection of the bellows 5 is a metal member which has a side section in a hook shape and has an annular shape as a whole. The second shielding plate 7*a* may have one end portion welded onto the movable electrode seal cup 7 and another end portion extending from the one end portion toward the movable contact 4 at the outside of the bellows 5.

The splash shielding plate 12 is a disk-like metal plate having a central through hole for allowing an end portion of the movable electrode 3 to be inserted therethrough. The splash shielding plate 12 may be welded onto the end portion of the movable electrode 3 and shield a rear side of the movable electrode 3 and the bellows 5 so as to protect them from metallic vapor generated due to arc.

Hereinafter, brief description will be given of a switching operation of contacts of the vacuum interrupter 100 according to the present disclosure with reference to FIG. 4.

When a driving force for opening the contacts of the vacuum interrupter 100 is transferred from a actuating unit (including a actuating source such as a motor, an actuator and a spring, and links as a driving force transfer unit connected to the corresponding actuating source), which is connected to provide the driving force to the movable electrode 3 of FIG. 4, the movable electrode 3 is moved up from a position of FIG. 4.

In turn, the movable contact 4 attached onto the end of the movable electrode 3 is separated from the corresponding stationary contact 2, completing the opening operation for the circuit. Here, if it is assumed that the electrical load side of the circuit is electrically connected to the movable electrode 3 and the electrical power source side of the circuit is electrically connected to the stationary electrode 1, the circuit is electrically broken.

When a driving force for closing the contacts of the vacuum interrupter is transferred from the actuating unit connected to provide the driving force to the movable electrode 3, the movable electrode 3 is moved down from the aforementioned opening position to the position of FIG. 4.

Accordingly, the movable contact 4 attached onto the end of the movable electrode 3 contacts the corresponding stationary contact 2, completing the closing operation for the circuit. Here, if it is assumed that the electrical load side of the circuit is electrically connected to the movable electrode 3 and the electrical power source side of the circuit is electrically connected to the stationary electrode 1, the circuit is electrically connected.

Hereinafter, description will be given of configurations and operations of the preferred embodiments of the present disclosure with reference to FIGS. 5 to 8, which are a longitudinal sectional view and horizontal sectional views of the part of the vacuum interrupter showing configurations for installing a central arc shielding plate according to the preferred embodiments.

As shown in FIGS. 5 to 8, the configurations of the ceramic container, the central arc shielding plate and the stationary electrode seal cup may obscure understanding of the characteristic configuration and operational effect of the present disclosure, so description thereof is omitted.

Figure 6:
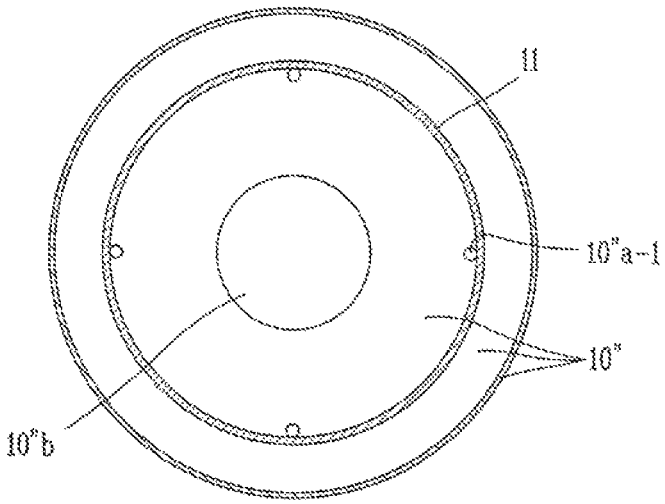
FIG. 6 is a horizontal sectional view of a part of the vacuum interrupter showing a configuration for installing a central arc shielding plate according to a first exemplary embodiment of this disclosure.

FIG. 6 is a horizontal sectional view of a part of the vacuum interrupter showing a configuration for installing a central arc shielding plate according to a first exemplary embodiment of this disclosure. As shown in FIG. 6, a stationary electrode seal cup 10" according to the first exemplary embodiment may include, as the protruding guide unit 10"*a*, a plurality of protrusion guide portions 10"*a*-1 formed along one circumference.

Referring to FIGS. 5 and 6, the stationary electrode seal cup 10" according to the first exemplary embodiment may include: an upright portion welded onto the ceramic container 8, a horizontal portion bent in a perpendicular direction to the upright portion and extending in the perpendicular direction, the plurality of protrusion guide portions 10"*a*-1 protruding from the horizontal portion in a direction perpendicular to the horizontal portion, and a central through hole 10"*b* formed through the center thereof to allow the stationary electrode 1 to be inserted therethrough.

Hereinafter, description will be given of a method for installing the central arc shielding plate 11 on the stationary electrode seal cup 10" according to the first exemplary embodiment as shown in FIG. 6.

The plurality of protrusion guide portions 10"*a*-1 of the stationary electrode seal cup 10" are inserted into the central arc shielding plate 11 so as to come in contact with an inner diameter portion of the central arc shielding plate 11. Accordingly, the central arc shielding plate 11 is aligned without being biased to one side in a radial direction. Afterwards, a lower surface of the central arc shielding plate 11 is welded onto the horizontal portion of the stationary electrode seal cup 10", completing the installation of the central arc shielding plate 11.

Figure 7:
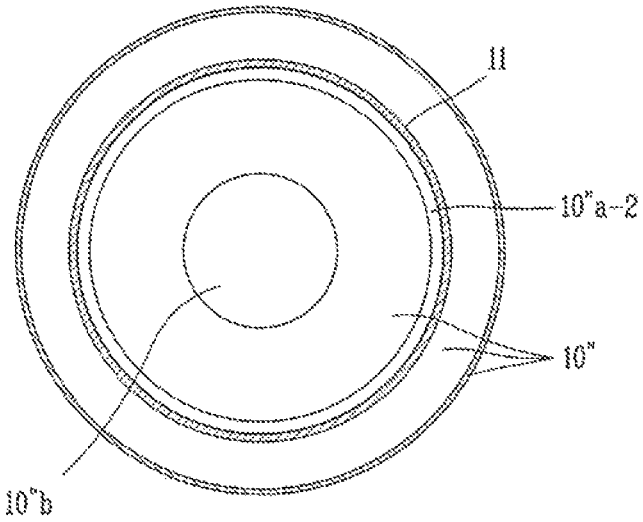
FIG. 7 is a horizontal sectional view of a part of the vacuum interrupter showing a configuration for installing a central arc shielding plate according to a second exemplary embodiment of this disclosure.

FIG. 7 is a horizontal sectional view of a part of the vacuum interrupter showing a configuration for installing a central arc shielding plate according to a second exemplary embodiment of this disclosure. Referring to FIG. 7, a stationary electrode seal cup 10" according to the second exemplary embodiment may include, as the protruding guide unit 10"*a*, one circular protrusion guide portion 10"*a*-2.

Referring to FIG. 5 and FIG. 7, the stationary electrode seal cup 10" according to the second exemplary embodiment may include: an upright portion welded onto the ceramic container 8, a horizontal portion bent in a perpendicular direction to the upright portion and extending in the perpendicular direction, one circular protrusion guide portion 10"*a*-2 protruding from the horizontal portion in a direction perpendicular to the horizontal portion, and a central through hole 10"b formed through the center thereof to allow the stationary electrode 1 to be inserted therethrough.

Hereinafter, description will be given of a method for installing the central arc shielding plate 11 on the stationary electrode seal cup 10" according to the second exemplary embodiment as shown in FIG. 7.

The circular protrusion guide portion 10"*a*-2 of the stationary electrode seal cup 10" is inserted into the central arc shielding plate 11 so as to come in contact with an inner diameter portion of the central arc shielding plate 11. Accordingly, the central arc shielding plate 11 is aligned without being biased to one side in a radial direction.

Afterwards, the lower surface of the central arc shielding plate 11 is welded onto the horizontal portion of the stationary electrode seal cup 10", completing the installation of the central arc shielding plate 11.

Figure 8:
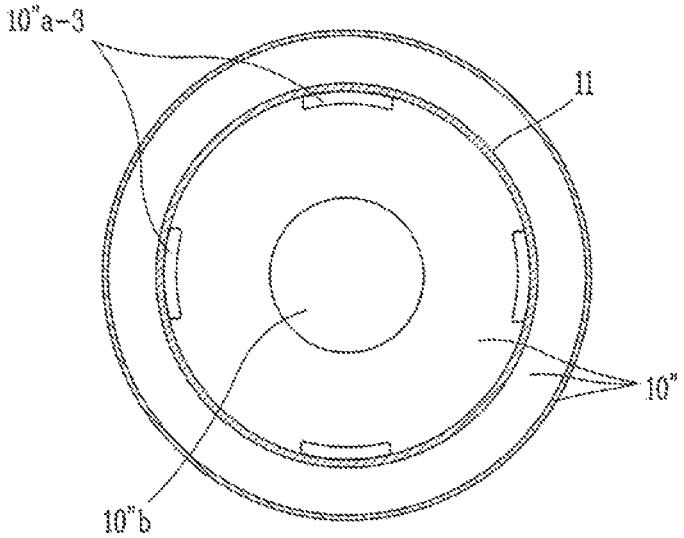
FIG. 8 is a horizontal sectional view of a part of the vacuum interrupter showing a configuration for installing a central arc shielding plate according to a third exemplary embodiment of this disclosure.

FIG. 8 is a horizontal sectional view of a part of the vacuum interrupter showing a configuration for installing a central arc shielding plate according to a third exemplary embodiment of this disclosure. The stationary electrode seal cup 10" according to the third exemplary embodiment may include, as the protruding guide unit 10"*a*, a plurality of arcuate protrusion guide portions 10"*a*-3 formed along one circumference.

Referring to FIG. 5 and FIG. 8, the stationary electrode seal cup 10" according to the third exemplary embodiment may include: a an upright portion welded onto the ceramic container 8, a horizontal portion bent in a perpendicular direction to the upright portion and extending in the perpendicular direction, a plurality of arcuate protrusion guide portions 10"*a*-3 protruding from the horizontal portion in a direction perpendicular to the horizontal direction along one circumference, and a central through hole 10"b formed through the center thereof to allow the stationary electrode 1 to be inserted therethrough.

Hereinafter, description will be given of a method for installing the central arc shielding plate 11 on the stationary electrode seal cup 10" according to the third exemplary embodiment as shown in FIG. 8.

The plurality of arcuate protrusion guide portions 10"*a*-3 of the stationary electrode seal cup 10" are inserted into the central arc shielding plate 11 so as to come in contact with an inner diameter portion of the central arc shielding plate 11. Accordingly, the central arc shielding plate 11 is aligned without being biased to one side in a radial direction.

Afterwards, the lower surface of the central arc shielding plate 11 is welded onto the horizontal portion of the stationary electrode seal cup 10", completing the installation of the central arc shielding plate 11.

For press-fitting into the central arc shielding late 11 of the vacuum interrupter, a diameter of the one circular protrusion guide portion 10"*a*-2 and a diameter of the one circumference on which the plurality of arcuate protrusion guide portions 10"*a*-3 are formed may have a value predetermined to correspond to the inner diameter of the central arc shielding plate 11.

In the vacuum interrupter according to the present disclosure, the circular, circumferential and the protrusion shapes according to the exemplary embodiments of the protruding guide unit 10"*a* of the stationary electrode seal cup 10" may be formed by the following simple method. That is, the stationary electrode seal cup 10" is pressed with being placed on a mold or frame, which protrudes to correspond to the circular, circumferential or protrusion shape according to the exemplary embodiments of the protruding guide unit 10"*a*, thereby being embossed into the corresponding shape.

The vacuum interrupter 100 according to the present disclosure may include the protruding guide unit 10"*a* protruding from the stationary electrode seal cup 10" in a perpendicular direction. Accordingly, upon installation of the central arc shielding plate 11, the protruding guide unit 10"*a* is inserted to come in contact with the inner diameter portion of the central arc shielding plate 11. This may guide the central arc shielding plate 11 to be aligned in a radial direction with preventing it from being biased to one side in the radial direction, and thus facilitate the installation of the central arc shielding plate 11.

As described above, a vacuum interrupter according to the present disclosure may include a protruding guide unit protruding from a stationary electrode seal cup in a perpendicular direction. Accordingly, upon installation of a central arc shielding plate, the protruding guide unit may be inserted to come in contact with an inner diameter portion of the central arc shielding plate. This may guide the central arc shielding plate to be aligned in a radial direction with preventing it from being biased to one side in the radial direction, and thus facilitate the installation of the central arc shielding plate.

The protruding guide unit of the vacuum interrupter may include one circular protrusion guide portion, which is inserted to come in contact with the inner diameter portion of the central arc shielding plate, thereby guiding alignment of the central arc shielding plate in a radial direction. This may allow the central arc shielding plate to be installed on a stationary electrode cover plate without being biased to one side in the radial direction and thus facilitate the installation of the central arc shielding plate.

The protruding guide unit of the vacuum interrupter may include a plurality of arcuate protrusion guide portions formed along one circumference. The plurality of arcuate protrusion guide portions may then be inserted to come in contact with the inner diameter portion of the central arc shielding plate, thereby guiding alignment of the central arc shielding plate in a radial direction. This may allow the central arc shielding plate to be installed on a stationary electrode cover plate without being biased to one side in the radial direction and thus facilitate the installation of the central arc shielding plate.

The protruding guide unit of the vacuum interrupter may include a plurality of protrusion guide portions formed along one circumference. The plurality of protrusion guide portions may then be inserted to come in contact with the inner diameter portion of the central arc shielding plate, thereby guiding alignment of the central arc shielding plate in a radial direction. This may allow the central arc shielding plate to be installed on a stationary electrode cover plate without being biased to one side in the radial direction and thus facilitate the installation of the central arc shielding plate.

For press-fitting into the central arc shielding plate of the vacuum interrupter, a diameter of the one circular protrusion guide portion and a diameter of the one circumference on which the plurality of arcuate protrusion guide portions are formed may have a value predetermined to correspond to the inner diameter of the central arc shielding plate. This may allow the corresponding plurality of protrusion guide portions to be inserted into the central arc shielding plate so as to come in contact with the inner diameter portion of the central arc shielding plate.

The stationary electrode seal cup of the vacuum interrupter may be pressed with being placed on a mold or frame, which protrudes to correspond to the circular, circumferential or protrusion shape of the protruding guide unit, thereby being embossed into the corresponding shape. This may have an effect of providing a simple fabricating method.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A vacuum interrupter comprising:

a stationary electrode;

a stationary contact coupled to the stationary electrode;

a movable contact movable to a position of contacting the stationary contact or a position of being separated from the stationary contact;

a movable electrode coupled to the movable contact to support the movable contact, the movable electrode movable together with the movable contact;

a ceramic container receiving the stationary contact and the movable contact therein, the ceramic container having upper and lower portions open;

a stationary electrode cover plate installed at a side of the stationary electrode and having a central through hole for allowing the stationary electrode to be inserted therethrough;

a stationary electrode seal cup connected to seal a gap between the ceramic container and the stationary electrode cover plate, and including a first portion and a second portion perpendicular to the first portion, wherein a plane of the second portion is parallel to a plane of the stationary electrode cover plate;

a movable electrode cover plate installed at a side of the movable electrode, and having a central through hole having a diameter greater than an outer diameter of the movable electrode to allow the movable electrode to be movable therethrough in an axial direction;

a movable electrode seal cup connected to seal a gap between the ceramic container and the movable electrode cover plate;

a bellows having a first end connected to the movable electrode cover plate and a second end connected to the movable electrode to seal a gap between the movable electrode cover plate and the movable electrode, the bellows being expandable or contractible in response to axial movement of the movable electrode;

a central arc shielding plate fixed between the ceramic container and the stationary and movable contacts; and a protruding guide unit protruding from the second portion of the stationary electrode seal cup in a direction perpendicular to the plane of the second portion to guide the central arc shielding plate to be installed in a fixed alignment in a radial direction with respect to a lengthwise axis of the stationary electrode.

2. The vacuum interrupter according to claim 1, wherein the protruding guide unit comprises one circular protrusion guide portion formed along one circumference.

3. The vacuum interrupter according to claim 1, wherein the protruding guide unit comprises a plurality of arcuate protrusion guide portions formed along one circumference.

4. The vacuum interrupter according to claim 1, wherein the protruding guide unit comprises a plurality of protrusion guide portions formed along one circumference.

5. The vacuum interrupter according to claim 2, or claim 3, wherein the circumference has a diameter corresponds to an inner diameter of the central arc shielding plate, such that the protruding guide unit is press-fitted into the central arc shielding plate.

6. The vacuum interrupter according to claim 1, wherein the protruding guide unit is embossed by pressing.

* * * * *